US006312742B1

(12) United States Patent
Wood et al.

(10) Patent No.: US 6,312,742 B1
(45) Date of Patent: Nov. 6, 2001

(54) BAG-IN-BAG PACKAGING SYSTEM

(75) Inventors: Alexander Charles Wood, Rotorua; Anthony Bourne, Auckland, both of (NZ); Uwe Kohn, Osnabruck (DE)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 09/367,389

(22) PCT Filed: Feb. 12, 1998

(86) PCT No.: PCT/NZ98/00017

§ 371 Date: Aug. 12, 1999

§ 102(e) Date: Aug. 12, 1999

(87) PCT Pub. No.: WO98/35886

PCT Pub. Date: Aug. 20, 1998

(30) Foreign Application Priority Data

| | | |
|---|---|---|
| Feb. 17, 1997 | (NZ) | 314258 |
| Jul. 9, 1997 | (NZ) | 328291 |
| Dec. 5, 1997 | (NZ) | 329346 |

(51) Int. Cl.[7] ..... B65D 85/00

(52) U.S. Cl. ..... 426/122; 426/124; 426/127; 426/130; 426/410; 383/111; 383/209

(58) Field of Search ..... 426/124, 106, 426/127, 410, 310, 122; 383/111, 209; 53/412, 449, 479

(56) References Cited

U.S. PATENT DOCUMENTS

| | | | |
|---|---|---|---|
| 3,190,441 | 6/1965 | Rausing | 206/46 |
| 3,552,638 | 1/1971 | Quackenbush | 229/66 |
| 3,807,626 | 4/1974 | Goodrich | 229/55 |
| 4,088,264 | 5/1978 | Vogt | 229/55 |
| 4,790,670 | 12/1988 | Barbaro | 383/62 |
| 5,281,027 | 1/1994 | Thrall | 383/88 |
| 5,529,396 | 6/1996 | Pryor et al. | 383/111 |
| 5,553,943 | 9/1996 | Cook et al. | 383/113 |
| 5,644,900 | 7/1997 | Steele et al. | 53/449 |
| 5,718,514 | 2/1998 | Steele et al. | 383/211 |

FOREIGN PATENT DOCUMENTS

| | | |
|---|---|---|
| B-32956/93 | 11/1993 | (AU) . |
| A-34588/95 | 2/1994 | (AU) . |
| 2128261 | 1/1996 | (CA) . |
| WO 96/09233 | 3/1996 | (WO) . |
| WO 99/03731 | 1/1999 | (WO) . |

*Primary Examiner*—Nina Bhat
(74) *Attorney, Agent, or Firm*—Mark B. Quatt

(57) ABSTRACT

Packaging such as a blockbase sack (201) suitable for packing of particulate material has an inner bag having two layers of polyethylene, surrounded by an outer bag (201) having three layers of polyethylene. Each bag has a closed bottom and has an open top (208) prior to filling. After filling of the inner bag, the inner bag is closed by a first heat seal along zone (205) in a heat-sealing operation, which can be performed through the outer bag (201) in such a way that the outer bag (201) is not heat sealed to the inner bag at that point. The outer bag (201) is closed by a second seal (207) located between the first seal (205) and the top of the bag (208). A frangible zone (206) is located between the first (205) and second (207) heat seals to enable the outer bag (201) to be removed from the sealed inner bag by cutting or tearing along the frangible zone (206).

34 Claims, 5 Drawing Sheets

FIG. 1
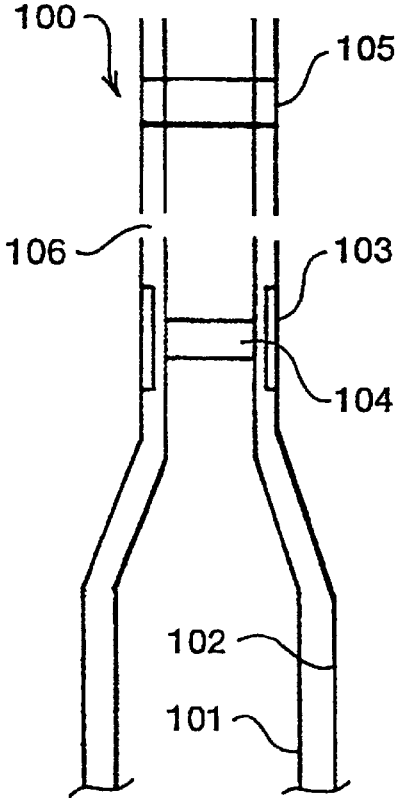
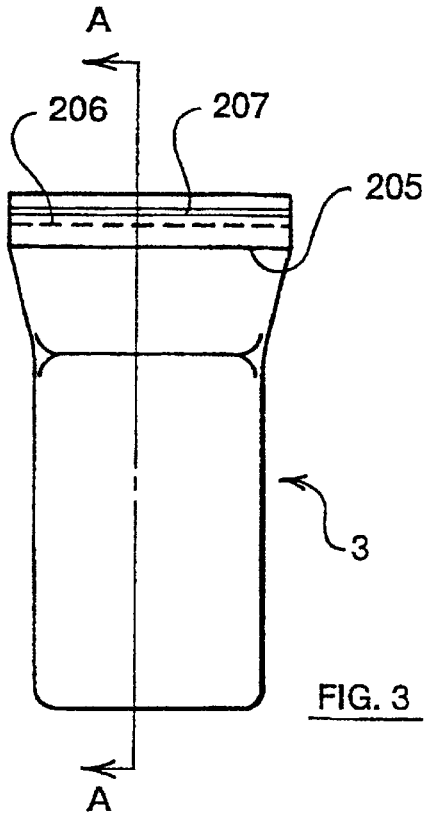
FIG. 3
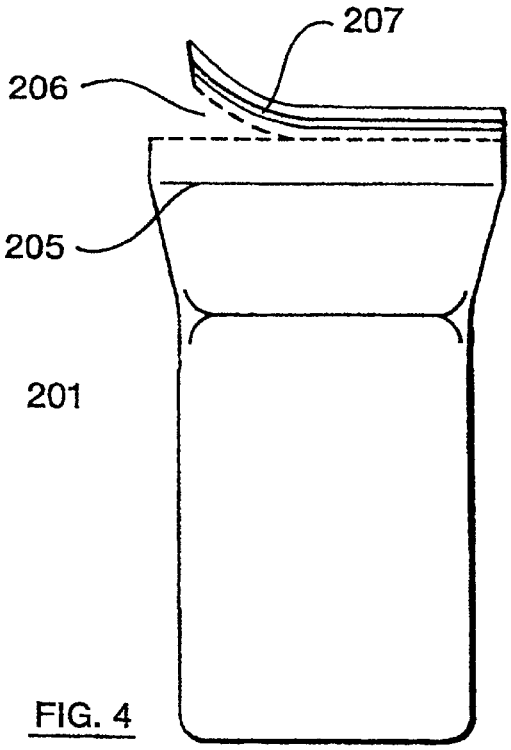
FIG. 4
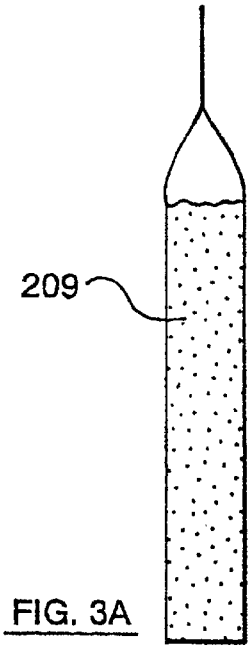
FIG. 3A

FIG. 8
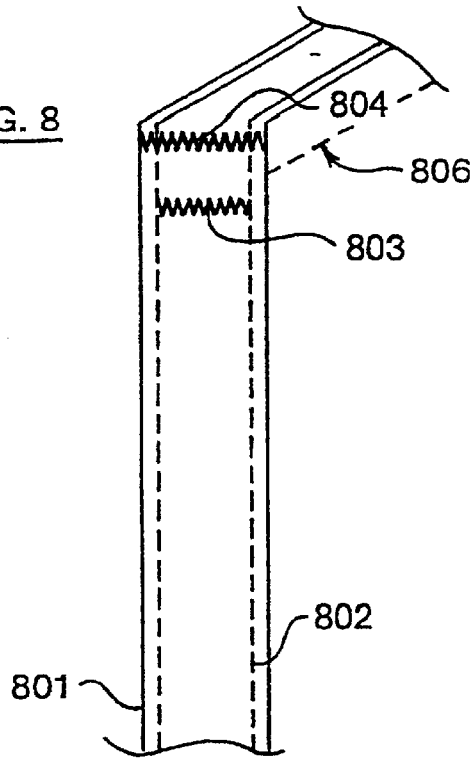
FIG. 9
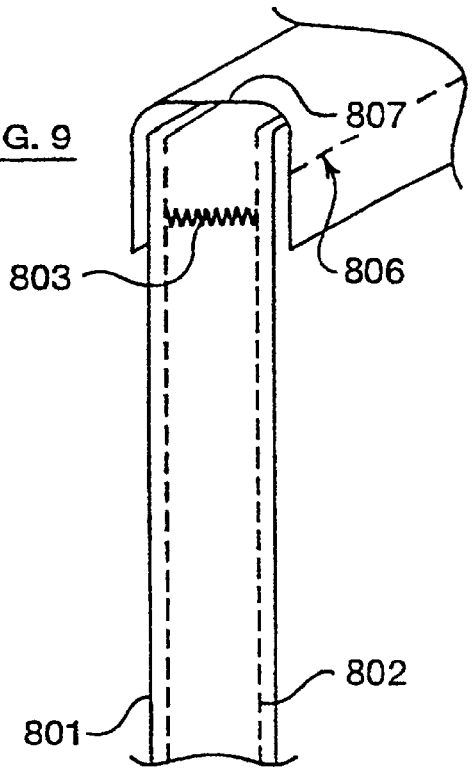
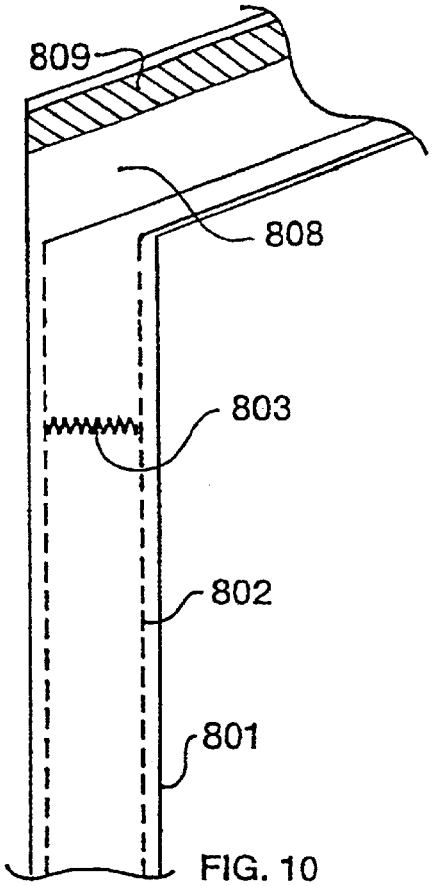
FIG. 10
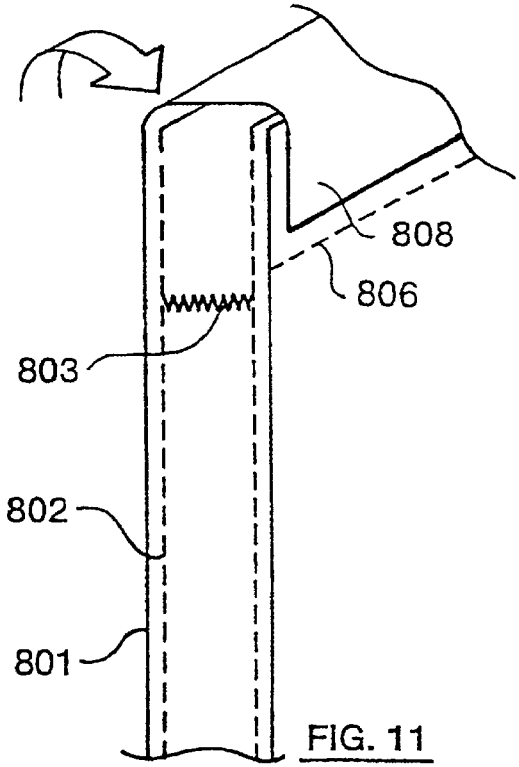
FIG. 11

BAG-IN-BAG PACKAGING SYSTEM

This application claims benefit under 35 U.S.C. 371 of PCT/NZ98/00017 filed Feb. 12, 1998.

The applicants claim foreign priority benefits under 35 USC 119 of New Zealand Patent Application No. 314258 having a filing date of Feb. 17, 1997, New Nealand Patent Application No. 328291 having a filing date of Jul. 9, 1997, and New Zealand Patent Application No. 329346 having a filing date of Dec. 5, 1997.

FIELD OF THE INVENTION

The invention relates to packaging and in particular to multi-ply flexible packaging such as bag-in-bag packaging Systems. More particularly the invention is concerned with top closure systems for such flexible packaging formed from plastics material and having an inner bag contained within but separate from an outer bag. Such packaging is suitable for foodstuffs or food grade materials or pharmaceuticals.

BACKGROUND

There is a use for a flexible packaging which offers an outer packaging to act as a protective or industrial shipping packaging combined with A inner packaging which is removable from the outer packaging whilst remaining sealed. The removable inner packaging acts to provide a hygienically packed product that has not been contaminated during shipping and is suitable to be taken into critical food hygiene areas.

There is a need to provide a flexible packaging as described above which is readily manufactured and can provide a sealed bag-in-bag approach.

DEFINITIONS

Bag means a container made from one or more plies of a flexible material, closed at least at one end. It includes but is not limited to "sacks, bags, pouches, and sachets", of any size or shape. Although size will vary from country to country, the term "sack" is often used for such containers capable of containing between 10 kg and 40 kg of product. "Bag" or "pouch" are sometimes used to refer to containers holding less than 10 kg of product. However in this specification "bag" is used in its generic sense irrespective of the weight of the product. In its most preferred form the specification describes a "bag-in-bg" packaging-system suitable for containing 25 kg of milk powder or milk powder derivatives; which in most countries would be referred to as a "sack".

Sack means a bag made essentially from one or more flattened tubular plies of flexible material (such as paper or plastic) closed at least at one end.

Ply means a sheet of flexile material forming the walls of a bag (or sack). We use "two ply bag" to refer to a "bag-in-bag" packaging system, ie "inner ply" refers to a wall of the "inner bag".

Film refers to a flexible material (typically a "plastics" material) whether it is made up of one layer or more than one layer of material.

OBJECT

It is an object of this invention to provide an improved package or an improved closure arrangement for a multi-ply flexible packaging or at least one that provides the public with a useful choice.

STATEMENT OF INVENTION

In one aspect the invention may broadly said to consist in an at least two ply bag comprising an inner ply contained within, but removable from, an outer ply, a mouth of the bag incorporating inner and outer sealing means, the inner sealing means adapting the inner ply only for sealing and the outer sealing means adapting at least the outer ply for sealing.

We use "two ply bag" to refer to a "bag-in-bag" packaging system, ie "inner ply" refers to a wall of the "inner bag".

Preferably a frangible zone is provided between the inner sealing means and the outer sealing means at least in the outer ply.

More preferably the frangible zone is formed by a weakened line formed in the at least outer ply material.

More preferably the frangible zone is formed by a weakened line in both the inner ply material and the outer ply material.

Preferably the inner seal and the outer seal are achieved by the application of heat through the layers of the inner ply and the outer ply.

Optionally, a non-sealable layer may be provided between the inner ply and the outer ply about the inner sealing means of the inner ply, or alternatively the inner plies may be sealed but the outer ply not sealed by suitable choice of time-temperature/pressure and materials.

Preferably the non-heat sealable layer is chosen from the group including but not limited to: solvent based varnish lacquers, water based solvent lacquers, and silicone disperions.

Preferably the at least inner ply is fabricated from weldable plastics material.

More preferably, the weldable plastics material is thermoplastic or composites of thermoplastics and other materials including, but not limited to: polyethylene coated paper and polyethylene coated woven polypropylene.

In another aspect the invention may broadly be said to consist in a method of sealing an at least two ply bag comprising an inner ply contained within, but removable from, an outer ply, a mouth of the bag incorporating inner and outer sewing means, the inner sealing means adapting the inner ply only for sealing and the outer sealing means adapting at least the outer ply for sealing.

Preferably a frangible zone is provided between the inner sealing means and the outer sealing means at least in the outer ply.

More preferably the frangible zone is formed by a weakened line formed in the at least outer ply material.

More preferably the frangible zone is formed by a weakened line in both the inner ply material and the outer ply material.

Preferably the inner seal and the outer seal are achieved by the application of heat through the layers of the inner ply and the outer ply, a non-sealable layer being provided between the inner ply and the outer ply about the inner sealing means of the inner ply.

Preferably the non-heat sealable layer is chosen from the group including but not limited to: solvent based varnish lacquers, water based solvent lacquers, and silicone dispersions.

Preferably the at least inner ply is fabricated from weldable plastics material.

More preferably, the weldable plastics material is thermoplastic or composites of thermoplastics and other materials including, but not limited to, polyethylene coated paper and polyethylene coated woven polypropylene.

In another aspect the invention may broadly be said to consist in a multi-ply bag having an inner ply and an outer ply constructed from heat sealable material, the inner ply being contained within, but removable from, the outer ply, wherein a strip of non-heat sealable material is applied on the inside of the outer ply or the outside of the inner ply near or adjacent to an open end of the outer ply or inner ply.

Preferably the non-heat sealable material is applied on the inside of the outer ply.

Preferably the non-heat sealable layer is chosen from the group including but not limited to: solvent based varnish lacquers, water based solvent lacquers, and silicone dispersions.

Preferably, a frangible zone is provided in the at least outer ply material, in the region of the non-heat sealable material or above the non-heat sealable material.

More preferably, the frangible zone is provided in the region of the non-heat sealable material.

Preferably the frangible zone is provided by a weakened line formed in the at least outer ply material.

In a further aspect, the invention may broadly be said to consist in a method for sealing an at last two ply bag constructed from heat sealable material, having an inner ply contained within, but removable from, an outer ply, wherein a strip of non-heat sealable material is applied on the inside of the outer ply or the outside of the inner ply near or adjacent to an open end of the outer ply or inner ply.

Preferably the non-heat sealable material is applied on the inside of the outer ply.

Preferably the non-heat sealable layer is chosen from the group including but not limited to: solvent based varnish lacquers, water based solvent lacquers, and silicone dispersions.

Preferably, a frangible zone is provided in the at least outer ply material, in the region of the non-heat sealable material or above the non-heat sealable material.

More preferably, the frangible zone is provided in the region of the non-heat sealable material.

Preferably the frangible zone is provided by a weakened line formed in the at least outer ply material.

Preferably, an at least one heat seal is applied to the two ply bag, said heat seal extending above and below the region where the non-heat sealable material is applied.

Alternatively, two heat seals are applied to the two ply bag, an upper seal being applied above the frangible zone and a lower seal being applied about the region where the non-heat sealable material is applied.

In a further aspect the invention may broadly be said to consist in a multi-ply bag having an inner ply and an outer ply constructed from non-heat sealable material, the inner ply being contained within, but removable from, the outer ply, wherein a strip of heat sealable material is applied on the inside of the outer play or the outside of the inner ply near or adjacent to an open end of the outer ply or inner ply.

Preferably the heat sealable material is applied on the inside of the outer ply.

Preferably, a frangible zone is provided in the at least outer ply material, in the region of the heat sealable material or above the heat sealable material.

More preferably, the frangible zone is provided in the region of the heat sealable material.

Preferably the frangible zone is provided by a weakened line formed in the at least outer ply material.

In a further aspect, the invention may broadly be said to consist in a method for sealing an at least two ply bag consumed from non-heat sealable material, having an inner ply contained within, but removable from, an outer ply, wherein a strip of heat sealable material is applied on the inside of the outer ply or the outside of the inner ply near or adjacent to an open end of the outer ply or inner ply.

Preferably the heat sealable material is applied on the inside of the outer ply.

Preferably, a frangible zone is provided in the at least outer ply material, in the region of the heat sealable material or above the heat sealable material.

More preferably, the frangible zone is provided in the region of the heat sealable material.

Preferably the frangible zone is provided by a weakened line formed in the at least outer ply material.

Preferably, an at least one heat seal is applied to the two ply bag, said heat seal being applied at least in the region of the heat sealable material.

In another aspect the invention provides packaging, including an inner bag having an interior surface and an exterior surface, surrounded by but removable from an outer bag having an interior surface and an exterior surface, each bag having a closed base and each bag having an open top, wherein the interior surface of the mouth of the inner bag has a heat sealable zone, and the interior surface of the mouth of the outer bag has (a) a non heat sealable zone corresponding to the location of the heat sealable zone of the inner bag, and (b) a sealable zone between the non heat sealable zone and the top of the bag, so that in use a heat sealing operation can be performed trough the outer bag to create a first seal capable of closing and sealing the mouth of the inner bag without sealing the outer bag at that non heat sealable zone, and a sealing operation can be performed at least on the outer bag to create a second seal to close and seal the outer bag at its sealable zone to enclose the sealed inner bag within the outer bag.

In a further aspect the invention provides a method of filling and sealing packaging of the type described in the immediately preceding paragraph, having an inner bag surrounded by but removable from an outer bag, wherein the packaging is supplied to a filling machine until the inner bag is filled to a desired amount, the mouth of the bag is stretched in order to flatten the inner and outer bags in the region of the first and second sealing zones, the inner bag is sealed along the first sealing zone to create a first seal without adhering to the outer bag and the inner and outer bags are sealed together in the region of the second sealing zone to create a second seal.

In a still further aspect of the invention, there is provided a package comprising packaging as described above, in which a filled inner bag is surrounded by but is removable from an outer bag, the inner bag is closed by a first heat seal but the outer bag is not heat sealed to the inner bag at that point, the outer bag is closed by a second seal located between the first seal and the top of the bag, and a frangible zone is located between the first and second seals so that in use the outer bag can be removed from the sealed inner bag by cutting or tearing along the frangible zone.

In another aspect the invention provides a method of emptying a package as described in the preceding paragraph, wherein the second seal is removed by tearing or cutting along the frangible zone between the first and second seals, and the completely sealed inner bag is removed from the outer bag.

DRAWINGS

The following is a description of the preferred forms of the invention given by way of example only and with reference to the drawings in which:

FIG. 1 shows a side cross-section of a top portion of two ply bag showing the seal configuration.

FIG. 3 illustrates the bag of FIG. 2 when filled and sealed.

FIG. 3A illustrates a sectional view on line A—A of the bag of FIG. 3.

FIG. 4 illustrates the bag of FIG. 3 with the outer bag partially open, demonstrating the opening of the outer bag, by tearing or cutting along the lines of the perforations.

FIG. 8 illustrates a flush cut closure for a two ply plastic bag having a first heat seal, and a second heat seal separated by a line of perforations.

FIG. 9 shows a flush cut closure for a twin ply plastic bag, having a first heat seal, a line of perforations, and a separate cap capable of being attached over the top of the inner and outer bags.

FIG. 10 illustrates a stepped top closure for a twin ply plastic bag having a first heat seal, a line of perforations, and hot melt or pressure sensitive adhesive provided within the stepped top.

FIG. 11 illustrates the bag of FIG. 10 with a pinch top closure for a twin ply plastic bag having a first heat seal, a line of perforations, and a flap on the outer bag capable of being folded over and sealed to cover the inner bag.

FIRST EXAMPLE

Figure 2:
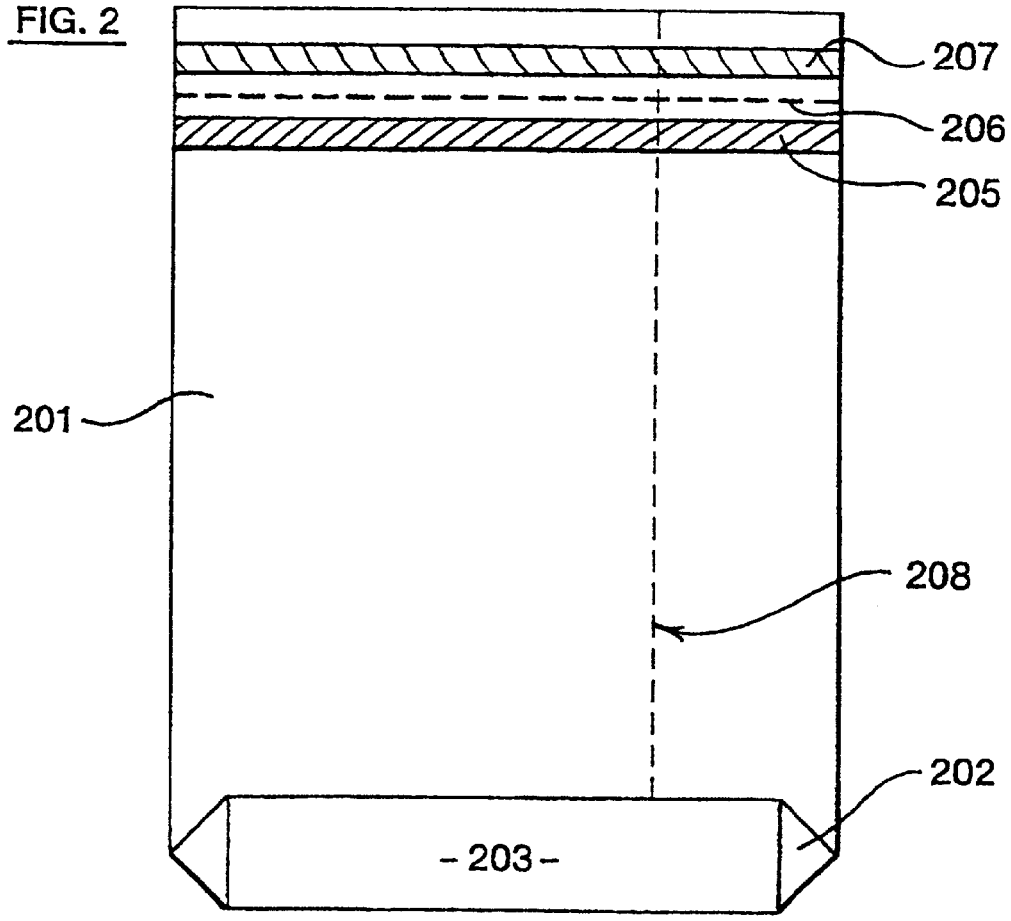
FIG. 2 illustrates a block base bag ready for filing.

A two-ply bag may be formed by commercially known means. The plies of the bag may be formed from thermoplastics or composites of thermoplastics and other materials such as polyethylene coated paper or polyethylene coated woven polypropylene. It is a feature of the invention that the resultant bag has an inner bag that is contained within, but removable from, an outer bag. The outer bag may be removed after transport and the inner bag taken into critical food hygiene areas, the inner bag having remained uncontaminated during transport and handling.

A multi-ply bag 100 is provided, having an inner ply 101 and an outer ply 102. At least one end of the inner ply 101 and at least one end of the outer ply 102 may be closed to form an inner bag and an outer bag respectively, each having an open end. The inner ply 101 and the outer ply 102 are both constructed from heat sealable materials for example, thermoplastics or composites of thermoplastics, polyethylene coated paper and polyethylene coated woven polypropylene.

A non heat sealable material 103, such as solvent based varnish lacquers, water based varnish lacquers or silicone dispersions, is applied in a strip to the inside of the outer ply 102 near the open end of the outer bag.

The bag 100 can be supplied to a customer for filling and sealing. In use two heat seals can then be applied to the package.

A lower heat seal 104 is applied at the non-heat sealable material position 103. An upper heat seal 105 is applied above and parallel to the lower heat seal 104. A gap is preferably left between the lower heat seal 104 and the upper heat seal 105. A frangible zone 106 is provided preferably in both the inner ply 101 and the outer ply 102 at a position between the lower heat seal 104 and the upper heat seal 105. A frangible zone 106 is preferably provided by perforations made in the inner ply 101 and the outer ply 102 at or just after the heat sealing stage. The frangible zone 106 enables the outer ply 102 to be readily removed from the inner ply 101 without affecting the integrity of the inner seal 104.

The lower heat seal 104 and the upper heat seal 105 are formed by application of heal The non-heat sealable material 103 allows the lower heat seal 104 to seal only the inner ply 101 to close and seal the inner bag.

The upper heat seal preferably seals the inner ply 101 and the outer ply 102 together, although if the inner bag stopped short of the top of the outer bag, only the outer bag could be sealed at upper heat seal 105.

Alternatively, only one heat seal may be applied to the multi-ply bag 100. The heat seal is applied in the region of the non-heat sealable material and extends above the non-heat sealable material, and thereby sealing the inner and outer ply together above the region of the non-heat sealable material. In this alternative, the frangible zone is provided in the region of the non-heat sealable material.

A paper outer ply may be used if desired. If a paper outer ply is used, the inside of the paper outer ply is coated with polyethylene or another thermoplastic, at least in the region where the heat seal or upper heat seal (in the case where an upper and lower heat seal is to be applied), to enable the heat seal between the inner ply and outer ply above the frangible zone to be effected.

In use, the inner bag is filled and the multi-ply bag is sealed as described above. After formation of the seals closing the multi-ply bag 100, transporting it to its destination, the outer bag may be opened along the frangible zone 106 leaving the inner bag sealed. The outer bag may then be removed and discarded while the inner bag remains intact and sealed.

SECOND EXAMPLE

In its most preferred form the bag is formed as a block bottom bag of the type shown in FIGS. 2, 3, 3A, and 4. It is particularly suited to the packaging of milk powder and milk powder derivatives, so that the bag-in-bag construction of this invention could be used to produce a "sack" capable of containing 25 kg of powder. By way of example such a "sack" could be 800–900 mm high, about 400 mm wide, and about 140–180 mm deep. In which case, the top section of the "sack" used for the first and second seals (the sealed portion shown in FIG. 3A) would be about 150 mm tall.

This bag has an inner bag (not shown) surrounded by an outer bag 201 having a block base 202 covered by a patch 203. Prior to filing the bag has a non heat sealing region 205 corresponding to a heat sealable region of the inner bag which will form a first seal to close the inner bag. After sealing a frangible zone 206 can be provided along line 206 to separate the first seal from a second seal which can be provided in zone 207 to seal at least the outer bag. Broken line 208 indicates the back seam of the outer bag.

In this embodiment it is possible to form the inner and outer bags of different, or slightly different, plastics materials, having different seal initiation points. When manufacturing the inner bag of, say, polyethylene having a seal initiation point of for example 10–15° C. lower than the seal initiation point of the outer bag, which could also be formed of polyethylene, it is possible to control the application time and temperature of the heat sealing bars to effect the first seal at a lower temperature than the second seal. If the application time and temperature and pressure of the first set of sealing bars is controlled so that sufficient heat is supplied through the outer bag to melt and thus seal the inner bag without it adhering permanently to the outer bag it is thus possible to seal the inner bag at zone 205, and then by providing a sufficient application time or higher temperature for the second set of sealing bars, it is possible to impart sufficient heat to seal the outer bag to the inner bag at zone 207. Either the inner or outer bag could be formed of a multilayer plastics web, depending upon the type of materials to be packaged within the bag.

FIG. 3 illustrates the bag-in-bag of FIG. 2 when filled and sealed. Note that the numerals 205–207 are used in FIG. 2 to refer to the zones in which the seals and the perforations are to be made when the bag is closed and sealed after filling, but in FIG. 3 these same numerals are used to refer to the location of the seal 205 made in the inner bag, the location of the seal 207 made in the outer and inner bags, and the perforations 206 extending through the outer and inner bags.

FIG. 3A illustrates the sealed bag-in-bag of FIG. 3 in cross-section to show the contents 209. The inner and outer bags fit closely together and have not been distinguished in this figure.

FIG. 4 illustrates the bag of FIG. 3 with the outer bag partially open, so that the second seal 207 can be removed by tearing or cutting along the line 206 of the perforations.

Figure 5:
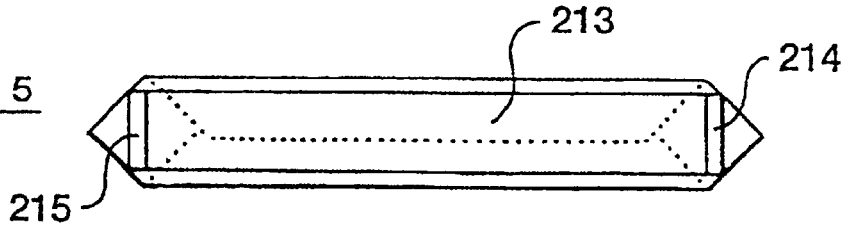
FIG. 5 illustrates a modified block base bag, with the patch providing gripping means.

FIG. 5 illustrates the block base of such a bag (as shown in FIGS. 2 to 4), wherein the patch 213 is lengthened (ie it is longer than patch 203), so that it provides two extending tabs 214, 215, which are not adhered to the base of the bag, thereby providing gripping means. A typical length for such gripping means would be 35 mm at each end of the patch 213.

When the bag of FIG. 5 reaches its destination, the top of the outer bag can be removed by pulling or cutting along the line of perforations, and then the bottom of the outer bag can be gripped by tabs 214, 215, and the inner bag dropped into a hopper or other receptacle, as the process worker holds onto the tabs on the outer bag, the weight of the material in the inner bag will cause it to pull free from the outer bag. As it will become apparent from the description of the manufacture of a block base bag in accordance with this invention, it is desirable to tack, or lightly attach, the inner bag to a lower portion of the outer bag during the manufacture and folding of the base of the outer bag. In which case, it is desirable that the attachment is by some form of adhesive which will pull free from the outer bag in this unloading operation.

Figure 6:
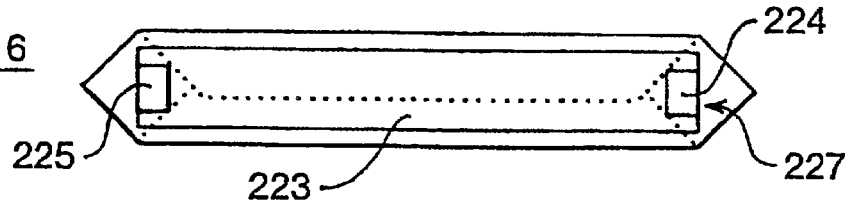
FIG. 6 illustrates a modified normal length patch, also providing gripping means on the base of the bag.

FIG. 6 illustrates a modified normal length patch 223, in which the adhesive is applied to the patch in all but two pockets 224, 225, so that the patch has two finger gripping regions 227 at each end of the patch.

Figure 7:
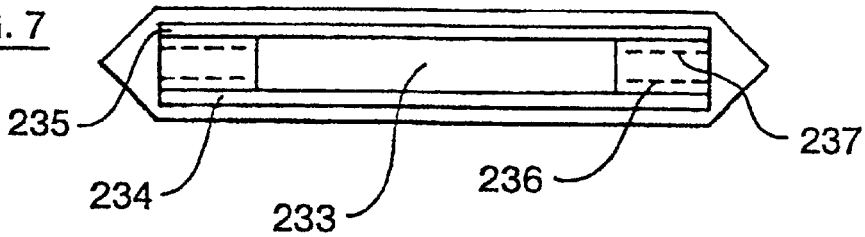
FIG. 7 illustrates an alternative arrangement in which the patch is secured along both edges to the base of the bag.

FIG. 7 illustrates an alternative arrangement in which the patch 233 is secured along both edges 234, 235 to the base of the bag, and in the central region, as marked, and that the patch has two sets of serrations or perforations 236, 237, enabling the bottom of the bag to be griped in a manner similar to FIG. 5, or alternatively the ends of the patch could be pulled, to produce two upstanding portions of the patch to facilitate gripping, by causing the ends of the patch to tear along the serration lines 236, 237.

FIGS. 8–11 show top closure variations for a multi-ply plastic bag-in-bag system, shown in isometric views. In each of these figures the outer bag is represented by numeral 801 and the inner bag is represented by numeral 802. It will be appreciated that these are schematic drawings, in order to illustrate the relationship of the first seal 803 used to seal the inner bag 802, and the second seal used to seal the outer bag. In FIG. 8, the bag has a flush cut closure (so that the top of the inner bag 802 is flush cut and corresponds with the top of the outer bag 801). In this case, the inner bag is heat sealed at 803, without the corresponding portion of the outer bag being sealingly engaged with the inner bag at 803, whilst the outer bag is heat sealed at 804 some distance above the location of heat seal 803. This heat seal 804 seals through both the inner and outer bags at that point. A line of perforations 806 can be cut through the bag, to enable the top of the bag to be readily removed, release the sealed inner bag from the now to be discarded outer bag 801.

FIG. 9 also illustrates a flush cut closure, but in this case the top of both the inner and outer bags 801, 802 am covered with a cap. Conveniently this may be a polyethylene or paper cap, which can be heat sealed, glued, sewn, or otherwise sealed in place. This cap 807 can be sewn through both the inner and outer bags 801 and 802, and a line of perforations 806 may be provided extending through the inner and outer bags, and if desired though the relevant portion of the cap.

FIG. 10 illustrates a stepped top closure, in which the inner bag is heat sealed at 803, and the stepped flap top 808 of the outer bag is provided with a layer of adhesive 809, typically a hot melt adhesive, or pressure sensitive adhesive, enabling the top flap 808 to be sealed against the external face of the outer bag 801.

FIG. 11 illustrates a stepped flap top closure, in which the outer bag 801 has a flap 808 capable of extending over the top of the inner bag 802, and being sealed against the external face of the outer bag 801. An inner bag is heat sealed at 803, and a line of perforations are provided at 806 extending through the top of both the inner and outer bags. Line 806 is located above heat seal 803 and preferably below the lower flap edge 808.

THIRD EXAMPLE

A two-ply bag, having an inner ply and an outer ply, may be formed by commercially known means. The inner ply and the outer ply are constructed from materials which cannot be heat sealed together, for example, the inner ply may be made from polyethylene and the outer ply made from woven fabric or paper. An at least one end of the inner ply is closed to form an inner bag and an at least one end of the outer ply is closed to form an outer bag.

A heat sealable material is applied in a strip near an open edge of the inside of the outer ply, or near an open edge of the outside of the inner ply. A frangible zone is provided in at least the outer ply, by perforating the outer ply below the beat sealable material.

The multi-ply bag is sealed by applying a heat to the region of the heat sealable material and to below the frangible zone. The inner ply is sealed below the region of the beat sealable material. The outer ply and inner ply are sealed together in the region of the heat sealable material.

In use, the inner bag is filled and the multi-ply bag is sealed as described above. After formation of the seals closing the multi-ply bag, the outer bag may be opened along the frangible zone leaving the inner bag sealed. The outer bag may then be removed and discarded while the inner bag remains intact and sealed.

FOURTH EXAMPLE

Figure 15:
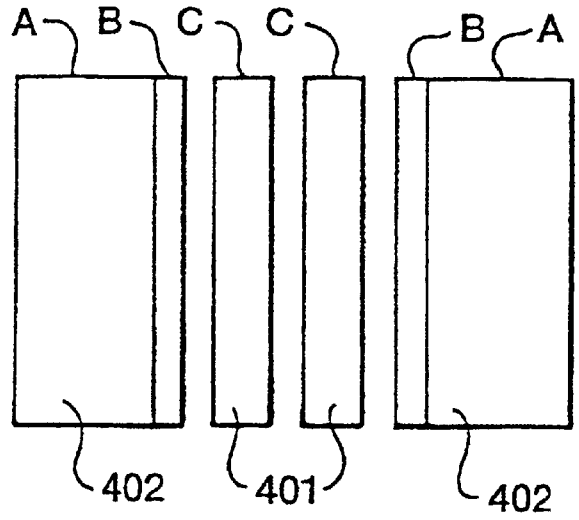
FIG. 15 is a cross-section of a bag construction in the most basic form to eliminate the need for an applied lacquer.

This is similar to the Second Example, in that a plastic bag—bag-in-bag construction is used. FIG. 15 illustrates a cross-section of such a bag construction, in its most basic form, to eliminate the need for an applied lacquer. In this arrangement the inner bag or bag 401 is formed from a single layer of plastics material, with its two side walls labelled C shown in cross-section. The use of letters A–E in FIGS. 15–17 helped to illustrate the different materials used for the different components of both the inner and outer bags. In this example, the inner bag 401 is formed of a single layer of plastics material, whilst the outer bag 402 is formed from a double layer of plastics material, the outermost layer being formed from material "A" whilst the innermost layer of the outer bag being formed from material "B".

In this example, material "A" is typically a linear low density polyethylene ("LLDPE") of a density between 900–930 kg/m$^3$.

In this material "B" is preferably linear medium density polyethylene ("LMDPE") of a density from preferably 935–940 kg/m$^3$.

Material "C" of the inner bag is preferably formed of material having a density below 926 kg/m$^3$, and hence having a lower seal initiation point than material "B" (the inner surface or inner layer of the outer bag 402). Such a bag is suitable for use in containing a stable product, ie one which does not require an oxygen barrier, or the like.

FIFTH EXAMPLE

Figure 16:
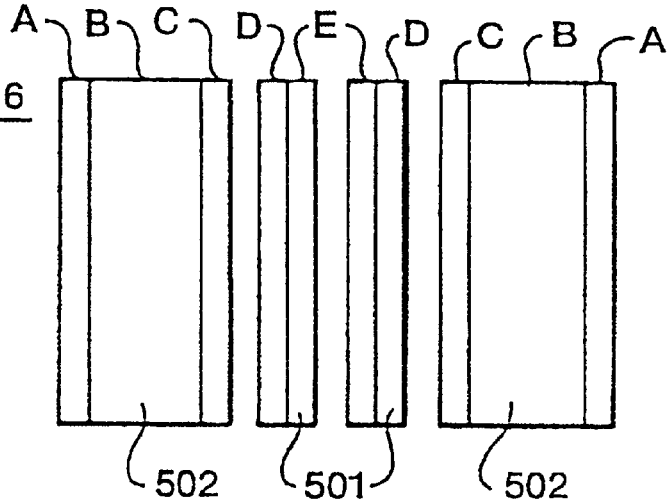
FIG. 16 is a cross-section of a preferred bag construction utilising the combination of a two layer inner bag combined with a three layer outer bag, to eliminate the need for an applied lacquer.
Figure 17:
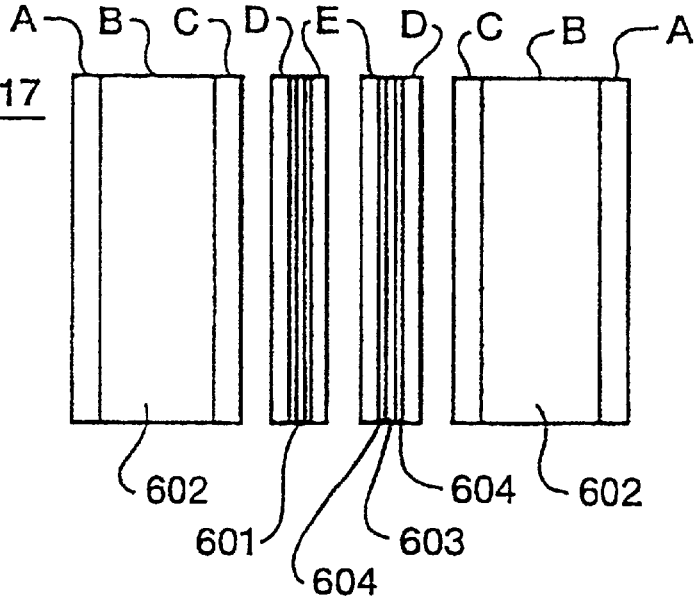
FIG. 17 illustrates a cross-section of a preferred bag construction, similar to that of FIG. 16, with the additional feature of the inner bag providing an oxygen barrier.

FIG. 16 illustrates an arrangement in which the inner bag 501 is formed from a two layer plastics web made up of materials "D" and "E", whilst the outer bag 502 is made up of a three layer plastics web comprising materials "A", "B" and "C". In this example the letters A–E do not stand for the same materials as the letter A–C in FIG. 15. Letters are used to show the difference between the different layers.

In this example, with reference to FIG. 16, material "A" is typically a linear low density polyethylene ("LLDPE") of a density preferably below 918 kg/m$^3$. Material "B" is preferably "LDPE" of a density between 900–930 kg/m$^3$.

Materials "C" and "D" are preferably "LLDPE" of a density between 935–940 kg/m$^3$.

Material "E", forming the inner surface of the inner bag 501 is preferably formed from a material having a density below 926 kg/m$^3$. Examples of suitable polyethylenes include "LLDPE" and "VLDPE". Such a material would typically have a seal initiation point below 107° C.

This bag could also be used for a stable product, in a similar fashion to that of the Fourth Example.

SIXTH EXAMPLE

This example is similar to that of the Fifth Example, with the addition of an oxygen barrier. The inner bag 601 is formed of five layers, described below, whilst the outer bag has three layers similar to the Fifth Example. In each case, the Fourth, Fifth and Sixth Examples illustrate constructions in which the inner and outer bags are formed from materials having different seal initiation points thereby minimising the need for the use of an applied lacquer. By suitably choosing the seal initiation points of the different surfaces of the inner or outer bags, it is possible to eliminate the need for an applied lacquer.

In this example, with reference to FIG. 16, material "A" is typically a linear low density polyethylene ("LLDPE") of a density preferably below 918 kg/m$^3$. Material "B" is preferably "LLDPE" of a density between 900–930 kg/m$^3$.

Materials "C" and "D" are preferably "LMDPE" of a density between 935–940 kg/m$^3$.

Material "E", forming the inner surface of the inner bag 601 is preferably formed from a material having a density below 926 kg/m$^3$. Examples of suitable polyethylenes include "LLDPE" and "VLDPE". Such a material would typically have a seal initiation point below 107° C.

The inner bag also includes adhesive and oxygen barrier materials between the layers "D" and "E". Preferably an oxygen barrier material such as ethylene vinyl alcohol copolymer "EVOH" is situated at 603, sandwiched between two layers 604 of an adhesive material, such as Maleic anhydride grafted polyethylene. It will be appreciated that these are examples only, and that other barrier materials may be used with or without other adhesives, examples include polyamides and other polymeric barrier materials.

In use, the bag-in-bag construction described with reference to the second example, and with reference to any one of the Fourth-Sixth Examples, operates in such a way that a heat seal can be achieved by applying a suitable time/temperature/pressure to the exterior surface of the outer bag, eg bags 402, 502, 602, with sufficient heat transmitted to the interior surfaces of the inner bags 401, 501, 601 such that the inner surfaces of the inner bag can be heat sealed together, without the exterior surfaces of the inner bag adhering permanently to the inner surface of the outer bag.

Manufacture of Plastic Bags

In the manufacture of bags in accordance with the Second Example, will now be described. The Second Example dealt with bags of the type shown in FIG. 2, in which both the inner and outer bags are formed of a similar plastics material, such as polyethylene, the difference between the bags being a slightly different seal initiation point, so that the inner bag has a slightly lower seal initiation point than the seal initiation point or sealing point of the outer bag.

Figure 12:
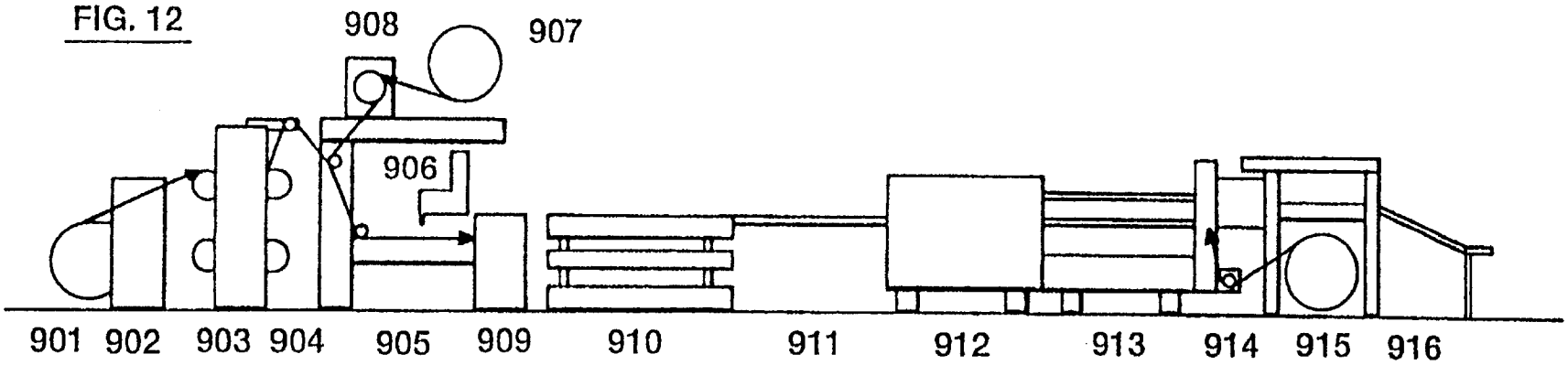
FIG. 12 illustrates a schematic diagram of a plastic conversion machine capable of producing the bags of this invention.

FIG. 12 is a schematic diagram of a typical plastic conversion machine for processing single or two layer tubular and flat web materials. The inner bag is preferably formed from a continuous plastic tube, whilst the outer bag will be formed from a flat web of plastic which is then folded about the inner tube to form the outer bag. It will be appreciated in some cases the inner bag could also be formed, in situ, from a flat web of plastic, prior to the formation of the outer bag around the inner bag.

FIG. 12 illustrates the following modules:

901 is an unwind unit for the outer web.

902 is an integral web treater station.

903 is a flexigraphic printer.

904 is a hot-melt interply paste unit.

905 is a former table.

906 is a longitudinal seam unit.

907 is an unwind unit for the inner web.

908 is the inner web heat sealer.

909 is the rotary cross cutter.

910 is the tube turning station.

911 is the tube aligner station.

912 is the creasing and bottom opening section.

913 shows the location of tree stations, namely the:

(a) tube bottom opening out station, (b) the tube bottom pasting station, and (c) the tube bottom closing station.

914 shows the location of the bottom patch printer/applicator.

915 shows the location of the bottom patch unwind unit.

916 shows the delivery counting and packing station for the completed bags.

In this arrangement the bag of FIG. 2 is formed, suitable for a flush cut closure of the type shown in FIG. 8. The inner bag is preferably formed from a co-axial tube having an inner surface of 926 kg/m$^3$ density or below polyethylene, which has a seal initiation point below 107° C. This is supplied as a roll, and mounted at 907.

Both the inner and outer bags could be printed, although it makes more sense to print only the outer bag as this will be visible in transit, then the outer bag can be removed prior to using the contents of the inner bag.

The inner bag is preferably formed from at least two layers of polyethylene with the inner layer of the inner bag having a lower seal initiation point than the outer layer of the inner bag, as will be explained below with reference to the layers of the outer bag. Preferably the inner layer of the inner bag comprises a polyethylene having a density below 926 kg/m$^3$ as they will have a seal initiation point below 107° C. Suitable polyethylenes include linear low density polyethylene ("LLDPE") and very low density polyethylene ("VLDPE").

The outer bag is preferably formed from a flat web of Free layer polyethylene. If the bag is to be used for containing milk powder, it is preferable that one of the layers is a light filter layer, such as a dark or black plastic, and it is most convenient that this be the innermost layer of the outer bag.

The outermost layer of the outer bag is preferably white, or pastel (for printing purposes) and the outermost layer is preferably formed of a high co-efficient of friction plastics material such as very low density polyethylene ("VLDPE"), to enable the outer bags to resist slipping, during stacking. The three layers of the outer bag, include a mid layer of typically white plastics material such as polyethylene.

The innermost layer of the outer bag is typically linear medium density polyethylene ("LMDPE") having a seal initiation point 15° C. higher than the seal initiation point of the interior surface of the inner bag, so that for example the innermost layer of the outer bag could be formed of 940 kg/m$^3$ density LMDPE having a seal initiation point of 120° C. In most cases it is preferable that the temperature differential between the seal initiation point of the innermost layer of the outer bag, and the outer surface of the inner bag is minimised, whilst the seal initiation point of the innermost layer of the outer bag together with the outer of the inner bag is maximised with respect to the innermost layer of the inner bag. Maintaining this difference to a minimum of 10° C. avoids the use of an applied lacquer. Alternatively in some cases the seal initiation points may be the same, in which case a lacquer, or other non-heat sealing layer may be applied to the inner surface of the outer bag, or the outer surface of the inner bag.

As will be apparent from FIG. 12, the outer web is unwound, printed, and is provided with hot melt paste before passing to the former table 905, at which it is folded about the inner tube to form an outer bag. In the meanwhile, the inner tube is unwound from unwind units 907, and is sealed by heat sealer 908 at fixed intervals to form the separate bags.

As the outer web is folded about the inner bags, the longitudinal seams of the outer bag are formed at station 906, and then the bags are sent to the rotary cross-cutter 909 to cut and separate the individual bags containing both an inner and outer bag. These individual bags are then turned at tube turning station 910, and are sequentially sent to the tube aligner station, prior to reaching the creasing and bottom opening station 912.

Preferably, during the provision of the hot melt adhesive at station 904, an area of adhesive is applied to what will become the inner base portion of the outer bag so that the lowermost portion of the inner bag is "tacked" to the bottom inside of the outer bag. This preferably takes place on only one face of the inner bag, so that it can be suitably held in place during creasing and forming of the block bottom of the outer bag. This small portion of adhesive, helps to locate the inner bag within the outer bag, and yet should be "releasable" so that the inner bag can drop free of the outer bag when the inner bag is removed from the outer bag at its destination.

Stations 913–915 relate to the provision of the folded block bottom on the outer bag, and the delivery of a separate bottom patch to the bottom of each outer bag, resulting in a folded block bottom bag of the type shown in FIGS. 2–7.

It will be appreciated that if the inner bag and outer bag are formed of plastics materials having different seal initiation points, then it is not necessary to provide a station for the provision of the lacquer or other non-sealable layer.

Such a production line is suitable for the production of 15–25 kg block bottom sacks, as such a size is suitable for the conveyance of milk powder, particulate chemicals, and other food products. Such sacks typically have dimensions of up to 1160 mm×600 mm.

The same type of conversion machine can be used to produce the bags of the first or third embodiment, with the addition of an appropriate station to provide either the heat resist lacquer, or a layer of heat sealing material to the appropriate portion of the inner or outer bag. In addition a similar machine could be used to provide those embodiments making use of an inner plastics bag and outer paper or woven bag.

Filling and Sealing of the Bags

Bags produced in accordance with FIGS. 2–7 can be supplied to an end user, for use in conjunction with a filling and sealing machine. A variety of filling machines can be used, depending upon the user's requirements. For example a user may use a single head bag filling machine, or a multiple bag filling machine such as an end line bag filler, or a carousel bag filler.

Depending upon the material to be filled into the inner bag, the bag filling machine may involve gas flushing, or vacuum packaging, in order to remove air from the inner bag. In some cases it may be desirable to form the inner or outer bag or both from suitable barrier materials preventing the ingress of oxygen, or the escape of an inner atmosphere, if that is used in the filling of the inner bag.

Once the inner bags have been filled, the filled bags can then be heat sealed. In order to heat seal the bags, it is preferable that the bags be passed to a neck stretching station so that the mouth of both the inner and outer bags are pulled taut so that they are held flat, and stretched prior to passing the filled bag to a bag levelling station. At this station the top of the bag is levelled, and aligned so that it can be passed to a heat sealing station to ensure that the heat seal or seals are provided at the appropriate locations on the bag.

In FIGS. 3 and 4 the width of the top of the bag is shown to be greater than the width of the bottom of the bag in order to exaggerate the stretching effect prior to heat sealing.

At the heat sealing station, a first set of heat sealing bars clamps the bag and heat is applied to the exterior of the outer bag so that the combination of heat and pressure together with the appropriate choice of materials for the inner and outer bag will enable the inner bag only to be beat sealed along line 205 in FIG. 3. In the case of the all plastic bag comprising a plastic inner and a plastic outer bag, the second set of heat sealing bars can apply heat and pressure to the top of both the inner and outer bag allowing it to be heat sealed through all four layers of material (treating the inner or outer bags as comprising a single tube irrespective of whether or not it is made up of multiple layers of material, hence the reference to two layers of material of the inner bag surrounded by the two layers of material of the outer bag). The second set of heat sealing bars by applying a higher temperature than the first set will cause both the inner and outer bags to be heat sealed together.

At the same time, the inner and outer bags can be perforated at 206 with the perforations being some distance from the heat seal line 205. This perforating step is desirable but not essential. In one embodiment, it is possible the outer bag may for example have a printed line coinciding with line 206 indicating where the bag should be cut or guillotined in order to separate the inner and outer bag. If perforations are used, it is also preferable to use a heated perforation knife to provide sealed edges to the formed perforations. This seals entry points to bag and will shear easily allowing separate removal of inner pack from outer.

Once the bags have been filled and sealed, the bags can then be moved from the vertical position to a horizontal position, and weighed, and provided with appropriate coding if desired. The bags are then preferably passed to a bag flattening station, in order to even out their contents, and make the bags more rectangular in outline, more suited to mechanised positioning of the filled bags on pallets.

ADVANTAGES

It is an advantage of the preferred embodiments of this invention that the outer bag may be opened and discarded while the inner bag remains intact and sealed. The inner bag is uncontaminated during shipping and may be taken into critical food hygiene areas after removal of the outer bag.

No materials such as glues are required to be stocked by the end user of the multi-ply flexible packaging, if the double heat seal all plastic bag combination is used, as both the inner and outer bags can be closed by heat sealing.

The preferred embodiments of this invention are particularly suited to the packing and transport of milk powders, milk powder derivatives, and other particulate food grade material. By packing the milk powder in a double plastics bag as described in the first preferred embodiment or in the combination of a plastics bag having a paper outer as described in the second preferred embodiment, the milk powder or other food grade material is packed within a polyethylene inner bag which can be closed and sealed by heat sealing. This inner polyethylene bag is water and dust tight and thus protects the contents from contamination. Prototypes of this invention have been tested on milk powder products and derivatives. It is envisioned that the invention will be suited to the packaging of milk proteins, whole skim milk, casein, salt, various food products, food ingredients, pharmaceuticals and other bulk products needing a "bag-in-bag" packaging system.

The outer bag whether it is formed of plastics, such as polyethylene, or paper, fulfils two main tasks. Firstly it protects the inner bag against damage, and secondly it keeps the inner bag clean. In addition the outer bag may be used for printing, and there is an added advantage if an outer plastics bag, as it is easier to provide high quality printing on the outer plastics bag. It is also possible to use different textures of plastics material, in order to improve the friction, and hence resistance to slipping, or slumping as a number of such bags are stacked on a pallet. The most preferred form of this invention makes use of the double plastic bag arrangement, as this allows the design of the outer bag to be controlled both for printing purposes, and for light resistance, and friction, and hence stackability. Moreover by using a double plastic bag arrangement as described above, it is possible to simplify the manufacture of the bags, and more importantly it has the advantage of simplifying the handling, and closure of the bags, as the double plastic bags in its most preferred form can be closed by beat sealing using preferably two sets of heat sealing bars in order to effect the closure of the inner bag at the first heat seal, and to effect closure of at least the outer bag at the second heat seal, with some form of perforation, or other easy opening arrangement between the first and second heat seal.

VARIATIONS

We have referred in the preferred embodiment to two ply bags. However, the invention may be applied to a multi-ply bags or sacks having three or more plies, eg bag-in-bag-in-bag.

The outer package may be closed with adhesives if necessary, after the inner package has been sealed.

Although the preferred embodiments have dealt with the manufacture, and use of larger bags, in the form of sacks suitable for shipping milk powder, containing for example 15 to 25 kg of product, the invention can also be used for a number of other sizes of bags or sacks.

Figure 14:
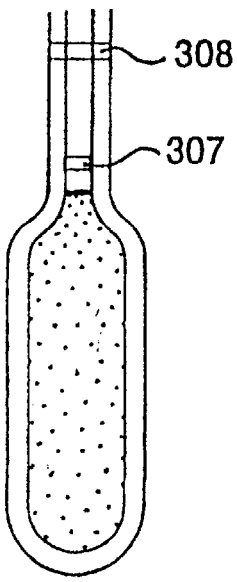
FIG. 14 illustrates the bag-in-bag arrangement of FIG. 13, with the neck of the two bags sealed in accordance with this invention.
Figure 13:
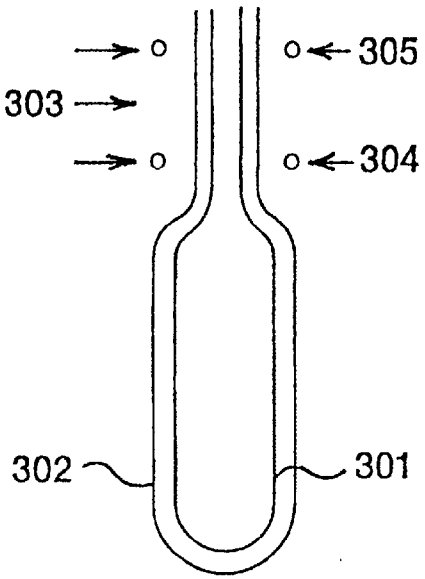
FIG. 13 illustrates a bulbous bag-in-bag arrangement for the transport of a liquid, shown prior to sealing.

For example sterile liquids could be packaged in small bulbous bags of say from 100 ml to 500 ml as shown in FIGS. 13 and 14. In this arrangement the inner bag 301 is slightly smaller than an outer bag 302, both are formed of a similar bulbous shape, having a long neck 303. By forming the inner bag of a lower seal initiation point material than the outer bag, it is possible to use a differential heat seal, along the neck of the bag 303 so that a first pair of heat sealing bars 304 can be applied to the outer bag 302 towards the bottom of the neck, and sufficient heat applied to heat seal only the inner bag at that point with a resulting heat seal at line 307, whilst the pair of heat seal bars 305 can operate at a higher temperature to ensure that both the inner and outer bags are sealed together at line 308.

By providing a clear separation between the heat seals 307 and 308, the heat seals will be rally apparent if the material of both packs is transparent, as is desirable for the transport of sterile liquids, thus it will not be necessary to perforate, or mark the neck of the bag to show where it should be cut between the two seals 307 and 308. Nevertheless, the outer bag could be overprinted with wording to indicate it should be cut between the two heat seal lines, or a coloured stripe could be positioned on the neck of the bag between the two heat seals, with an indication on the outer bag that the neck of the bag should be cut at the coloured stripe in order to separate the inner and outer bag.

A similar arrangement could be used for vacuum packaging of food products such as poultry, cheese, fruit or vegetables, where longer life, or longer transport requirments make it desirable that the food be packed in a "bag-in-bag" approach.

Many other variations are possible. It is for this reason that the discussion in FIG. 1 showed only the neck of the pack rather than the shape, or base of the bag, in order to emphasise the inventive feature of the "bag-in-bag" arrangement allowing the sealing of the inner bag distinct from the sealing of the outer bag, at least at the first heat seal.

TABLE 1

| Option | 1 | 2 | 3 | 4 | 5 | 6 | 7 | 8 | 9 |
|---|---|---|---|---|---|---|---|---|---|
| Reverse lacquer | ✓ | X | ✓ | X | X | ✓ | X | X | ✓ |
| Twin seal | ✓ | ✓ | X | X | X | ✓ | ✓ | ✓ | ✓ |
| Independent seal control | X | ✓ | X | X | X | X | ✓ | ✓ | X |
| Perforation | ✓ | ✓ | X | X | X | ✓ | ✓ | ✓ | ✓ |
| Differential seal materials | X | ✓ | X | ✓ | X | X | ✓ | ✓ | X |
| Low temperature inner tube sealant | X | ✓ | X | ✓ | X | X | ✓ | ✓ | X |
| High temperature outer sheet sealant interface | X | ✓ | X | ✓ | X | X | ✓ | ✓ | X |
| Incompatible polymers | X | X | X | X | ✓ | X | X | X | X |
| Applied adhesive tape | X | X | ✓ | ✓ | ✓ | ✓ | ✓ | X | X |
| Lower seal only | X | X | ✓ | ✓ | ✓ | X | X | X | X |
| Heated perforation bar | X | X | X | X | X | X | X | ✓ | ✓ |

Table 1 is a table showing a number of different options where ticks in a column show the features applicable to a particular option. For example: Option 1 makes use of the lacquer to prevent sealing between the exterior surface of the inner ply and the interior surface of the outer ply; whilst Option 2 avoids sealing of the outer plies by use of different temperature coefficient sealants.

Explanation of table options

1. Twin seal with lower seal over reverse lacquer non heat sealable coating, perforation existing between two seals. Allows for manufacture of a bag utilising the simplest of plastic films. The closure design is functional due to the applied lacquer. Incurs the cost of lacquer application and has another variable to control in manufacturing.
2. Twin heat seals effected by sealer design having individual control of process variables, temperature, dwell time and pressure, to seal differential sealing materials. Lower seal to close inner tube having low temperature sealant on inner faces. Upper seal operating at higher settings to seal more difficult material. Perforation exists between seals. Offers lower material costs than 1 with simplified bag making. Investment in film extrusion equipment is higher.
3. As for 1 or 2 or alternatively using incompatible thermoplastics, ie polyethylene to polyamide. Lower seal effects inner tube closure, upper seal position not used, but outer package closed by use of an adhesive tape. A bag as per 1, but utilising alternative closure means of outer bag. This would be useful for customers who would not accept the outer bag having a row of perforations. Forces a disadvantage of the customer requiring additional closing equipment to apply adhesive tape and stocking of a consumable with its added cost
4. A hybrid of 2 and 3, eliminating the need for applied lacquer in the manufacture of the bag. Incurs the disadvantages of both 2 and 3.
5. A variant of 4 where an incompatible polymer exists on one surface of the bag plies. This could be on the inner surface of the outer bag or outer surface of the inner bag. Total film costs are increased.
6. A variant of 1, utilising the features of option 1 and adding an applied adhesive tape over the row of perforations. Incurs additional closing equipment and consumable costs as in option 3.
7. A variant of 2, as 6 is of 1.
8. A variant of 2 utilising a heated perforation knife to seal the edges of the perforations made. This is to offer total exclusion of external contaminant.
9. A variant of 1 as 6 is of 2.

It will be appreciated that a variety of other changes might be made to the above examples without departing from the general scope of the invention, as set forth in the claims.

What is claimed is:

1. An article comprising:

a) a thermoplastic inner bag having an interior surface, an exterior surface, and an open top; and b) a thermoplastic outer bag having an interior surface, an exterior surface, and an open top, the outer bag surrounding but removable from the inner bag;

wherein:

i) the interior surface of the thermoplastic inner bag has a first heat sealable zone;

ii) the interior surface of the thermoplastic outer bag has a non heat sealable zone corresponding to the location of the first heat sealable zone of the inner bag, and iii) the thermoplastic inner bag and the thermoplastic outer bag are adapted such that a heat sealing operation can be performed through the outer bag to create a seal which closes and seals the inner bag to itself in the first heat sealable zone, without sealing the outer bag to the inner bag in the non heat sealable zone.

2. The article of claim 1 wherein the interior surface of the thermoplastic inner bag has a lower seal initiation temperature than the seal initiation temperature of the interior surface of the thermoplastic outer bag.

3. The article of claim 1 wherein the thermoplastic outer bag comprises a three layer film having:

a) an interior layer comprising linear medium density polyethylene;

b) an exterior layer comprising a material selected from the group consisting of linear low density polyethylene, and very low density polyethylene, and c) an intermediate layer comprising linear low density polyethylene having a density of between 900 and 930 $kg/m^3$.

4. The article of claim 1 comprising a non heat sealable layer or strip disposed on the exterior surface of the thermoplastic inner bag in the region of the non heat sealable zone of the thermoplastic outer bag.

5. The article of claim 4, wherein the non heat sealable layer or strip is selected from the group consisting of solvent based varnish lacquers water based solvent lacquers, and silicone dispersions.

6. The article of claim 4 comprising a frangible zone located in the region of the non heat sealable layer or strip.

7. The article of claim 1 comprising a non heat sealable layer or strip disposed on the interior surface of the thermoplastic outer bag in the region of the non heat sealable zone of the thermoplastic outer bag.

8. The article of claim 7, wherein the non heat sealable layer or strip is selected from the group consisting of solvent based varnish lacquers, water based solvent lacquers, and silicone dispersions.

9. The article of claim 7 comprising a frangible zone located in the region of the non heat sealable layer or strip.

10. The article of claim 1 comprising a second heat sealable zone, located between the top of the bags and the non heat sealable zone, wherein a heat sealing operation can be performed at least on the outer bag to create a heat seal in the second heat sealable zone.

11. The article of claim 10 wherein a heat sealing operation can be performed to seal both the inner and outer bags together.

12. The article of claim 1 wherein the thermoplastic inner bag and the thermoplastic outer bag are made from different materials.

13. The article of claim 1 wherein the thermoplastic inner bag comprises polyethylene.

14. The article of claim 1 wherein the thermoplastic inner bag comprises a monolayer film.

15. The article of claim 1 wherein the thermoplastic inner bag comprises a multilayer film.

16. The article of claim 1 wherein the thermoplastic inner bag comprises a multilayer film comprising:

a) an interior layer comprising a material selected from the group consisting of linear low density polyethylene, and very low density polyethylene; and b) an exterior layer comprising linear medium density polyethylene.

17. The article of claim 1 wherein the thermoplastic inner bag comprises a five layer film having:

a) an interior layer comprising a material selected from the group consisting of linear low density polyethylene, and very low density polyethylene;

b) an exterior layer comprising linear medium density polyethylene, c) a central layer comprising an oxygen barrier material; and d) an adhesive material disposed between the oxygen barrier material and each of the interior and exterior layers respectively.

18. The article of claim 1 wherein the thermoplastic outer bag comprises a material selected from the group consisting of polyethylene, polyethylene coated paper, and polyethylene coated woven polypropylene.

19. The article of claim 1 wherein the thermoplastic outer bag comprises a monolayer film.

20. The article of claim 1 wherein the thermoplastic outer bag comprises a multilayer film.

21. The article of claim 1 wherein the thermoplastic outer bag comprises a multilayer film comprising:

a) an interior layer comprising linear medium density polyethylene; and b) an exterior layer comprising a material selected from the group consisting of linear low density polyethylene, and very low density polyethylene.

22. The article of claim 1 wherein the thermoplastic inner bag comprises a three layer film having:

a) an interior layer comprising linear medium density polyethylene;

b) an exterior layer comprising a material selected from the group consisting of linear low density polyethylene, and very low density polyethylene, and c) an intermediate layer comprising linear low density polyethylene having a density of between 900 and 930 $kg/m^3$.

23. The article of claim 1 wherein the thermoplastic outer bag has a closed bottom, and the thermoplastic inner bag has a closed bottom.

24. The article of claim 1 wherein the thermoplastic outer bag has a block bottom.

25. The article of claim 24 wherein the thermoplastic outer bag has a gripping means on the bottom thereof so that in use a user can grip the bottom of the bag to facilitate removal of the inner bag and its contents from the outer bag.

26. The article of claim 10 comprising a frangible zone located between the first heat sealable zone and the second heat sealable zone.

27. The article of claim 26 wherein the frangible zone is formed by perforations extending through both the inner and outer bags.

28. The article of claim 10 comprising a printed cut line located between the first heat sealable zone and the second heat sealable zone.

29. A method of filling and sealing an article comprising:

a) providing an article as claimed in claim 1;

b) advancing the article to a filling machine;

c) filling the inner bag with a product until the inner bag is filled to a desired amount;

d) stretching the tops of the inner and outer bags in order to flatten the inner and outer bags in the region of a first and a second heat sealable zone;

e) sealing the inner bag along the first heat sealable zone to create a first seal without adhering the inner bag to the outer bag; and f) sealing at least the outer bags together in the region of the second heat sealable zone to create a second seal.

30. The method of claim 29 comprising providing a frangible zone between the first and second heat sealable zones.

31. A package comprising an article as claimed in claim 1, having a filled inner bag, surrounded by but removable from an outer bag, the inner bag closed by a first heat seal while the outer bag is not heat sealed to the inner bag at that point, the outer bag closed by a second heat seal located between the first seal and the top of the outer bag, and a frangible zone located between the first and second seals so that in use the outer bag can be removed from the sealed inner bag by cutting or tearing along the frangible zone.

32. A package as claimed in claim 31, wherein the frangible zone is formed by perforations extending through both the inner and outer bags.

33. A package as claimed in claim 31, wherein the filled inner bag contains a milk powder product or milk powder derivative.

34. The article of claim 1 comprising a second zone, located between the top of the bags and the non heat sealable zone, wherein a closing operation can be performed at least on the outer bag by using an adhesive to close the outer bags together in the second zone.

* * * * *